US008752875B1

(12) United States Patent
Gerhardt

(10) Patent No.: US 8,752,875 B1
(45) Date of Patent: Jun. 17, 2014

(54) ELECTRONIC DEVICE HOLDING SYSTEM

(76) Inventor: Michael J. Gerhardt, Lewisville, TX (US)

( * ) Notice: Subject to any disclaimer, the term of this patent is extended or adjusted under 35 U.S.C. 154(b) by 185 days.

(21) Appl. No.: 13/334,445

(22) Filed: Dec. 22, 2011

(51) Int. Cl.
*A45F 5/00* (2006.01)
*B25J 15/06* (2006.01)

(52) U.S. Cl.
USPC ..... 294/165; 294/212

(58) Field of Classification Search
USPC ..... 294/25, 137, 153, 154, 162, 165, 212; 455/575.1, 575.7; 15/104.002, 209.1
See application file for complete search history.

(56) References Cited

U.S. PATENT DOCUMENTS

| | | | |
|---|---|---|---|
| 4,771,927 | A | 9/1988 | Ventura |
| D363,284 | S | 10/1995 | Solomita |
| 5,537,472 | A | 7/1996 | Estevez-Alcolado et al. |
| 6,278,179 | B1 | 8/2001 | Mermet-Guyennet |
| 7,542,565 | B2 | 6/2009 | Tsutaichi et al. |
| 2005/0277452 | A1 | 12/2005 | Pasamba |
| 2005/0282598 | A1 | 12/2005 | Hinkey |

*Primary Examiner* — Paul T Chin

(57) ABSTRACT

An electronic device holding system having a panel with a first end and a second end opposite the first end, a third end and a fourth end opposite the third end, a handle surface, and an attachment surface, a handle is pivotally attached to the handle surface and can pivot either in a first direction toward the third end of the panel and a second direction toward the fourth end of the panel, or in a third direction toward the first end of the panel and a fourth direction toward the second end of the panel, and a first half attachment means on the attachment surface and a second half attachment means for attaching to a smart phone, tablet, or electronic reader, the first half attachment means is adapted to temporarily engage the second half attachment means.

2 Claims, 3 Drawing Sheets

SIDE VIEW

SIDE VIEW

ELECTRONIC DEVICE HOLDING SYSTEM

BACKGROUND OF THE INVENTION

It can be difficult to text or use a smart phone, tablet, electronic reader, or other electronic devices while lying down or in unusual positions. For example, users may have difficulty simultaneously gripping the phone or device and using their thumbs to operate the device. The present invention features an electronic device holding system for devices including but not limited to smart phones, tablets, and e-readers. The system of the present invention helps the user have unrestricted use of his/her thumbs for operating the phone or device in a quick and efficient manner. The system of the present invention helps improve the speed and ease of texting or using a smart phone, tablet, electronic reader, or the like while lying down or in other unusual positions. Furthermore, the system can help protect the device from damage if the device is dropped.

SUMMARY

The present invention features an electronic device holding system. In some embodiments, the electronic device holding system for holding a smart phone, tablet, or electronic reader comprises a panel having a first end, a second end opposite the first end, a third end, a fourth end opposite the third end, a handle surface, and an attachment surface; a handle pivotally attached to the handle surface of the panel, the handle can pivot either in a first direction in the direction of the third end of the panel and a second direction in the direction of the fourth end of the panel or in a third direction in the direction of the first end of the panel and a fourth direction in the direction of the second end of the panel; and a first half attachment means disposed on the attachment surface of the panel and a second half attachment means for attaching to the smart phone, tablet, or electronic reader, the first half attachment means is adapted to temporarily engage the second half attachment means.

In some embodiments, a length of the panel as measured from the first end to the second end is longer than a width of the panel as measured from the third end to the fourth end.

In some embodiments, the handle is a bar having two ends, each end being pivotally attached to the handle surface of the panel and the handle pivoting in the first direction and the second direction. In some embodiments, the handle is a pair of T-bar pivotally attached to the handle surface of the panel that can pivot in the third direction and the fourth direction.

In some embodiments, the first half attachment means comprises a hook-and-loop fastener mechanism, a magnet mechanism, an adhesive mechanism, a latch mechanism, a clip mechanism, a snap mechanism, or a combination thereof. In some embodiments, the second half attachment means comprises a device attachment component for attaching to the smart phone, tablet, or electronic reader. In some embodiments, the device attachment component is an adhesive. In some embodiments, the device attachment component is temporarily covered by a protective backing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
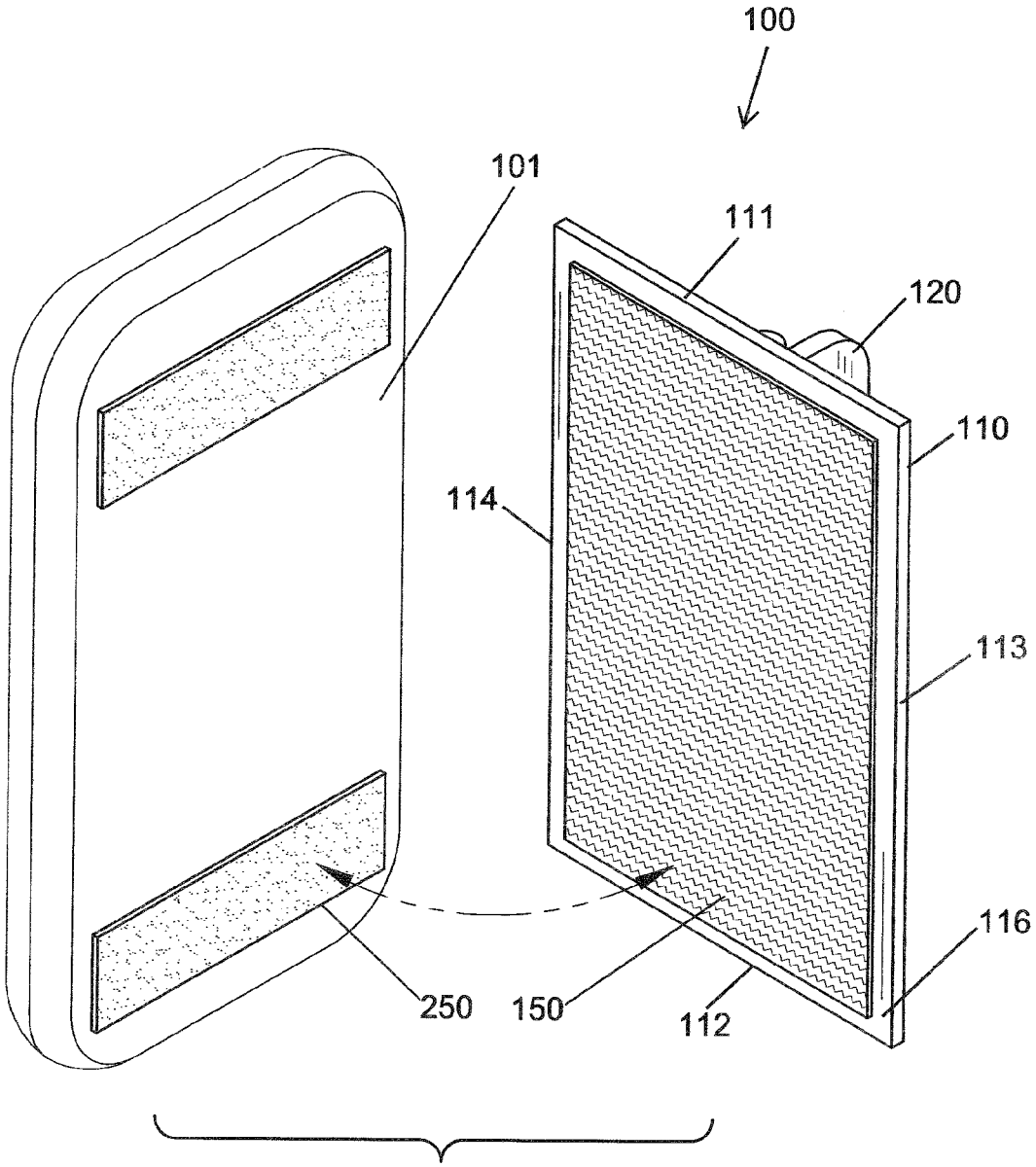
FIG. 1 is an in-use view of the system of the present invention.

Referring now to FIG. 1-5, the present invention features an electronic device holding system 100 for devices including but not limited to smart phones, tablets, and e-readers. The system of the present invention helps the user have unrestricted use of his/her thumbs for operating the phone or device in a quick and efficient manner. The system of the present invention helps improve the speed and ease of texting or using a smart phone, tablet, electronic reader, or the like while lying down or in other unusual positions.

The system 100 of the present invention comprises a panel 110 having a first end 111, a second end 112 opposite the first end 111, a third end 113, a fourth end 114 opposite the third end 113, a handle surface 115, and an attachment surface 116. The panel 110 may be constructed in a variety of sizes to accommodate various devices (e.g., a smart phone 101, a tablet, an e-reader, etc.). In some embodiments, the length of the panel 110 (as measured from the first end 111 to the second end 112) is longer than the width of the panel 110 (e.g., as measured from the third end 113 to the fourth end 114), however the panel 110 is not limited to this configuration.

Figure 2:
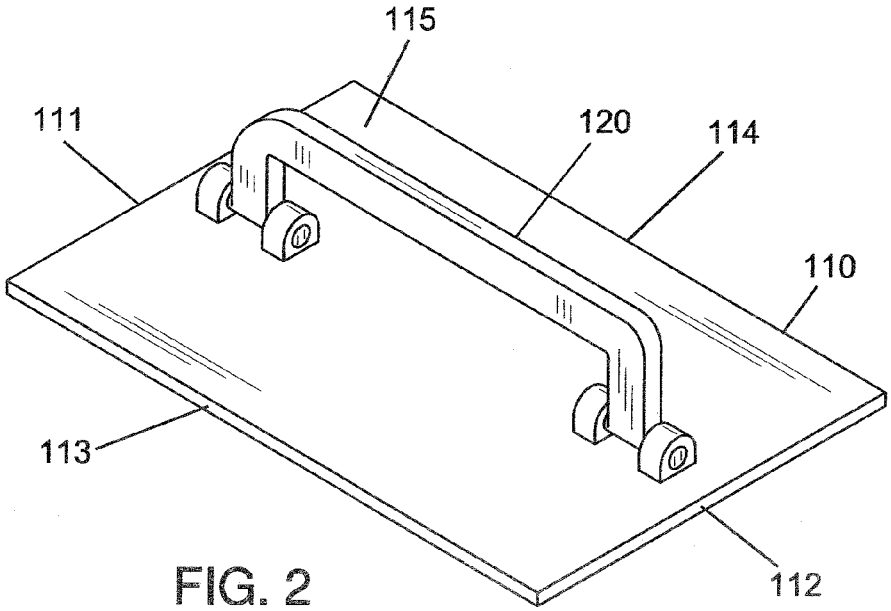
FIG. 2 is a perspective view of the system of the present invention.
Figure 3:
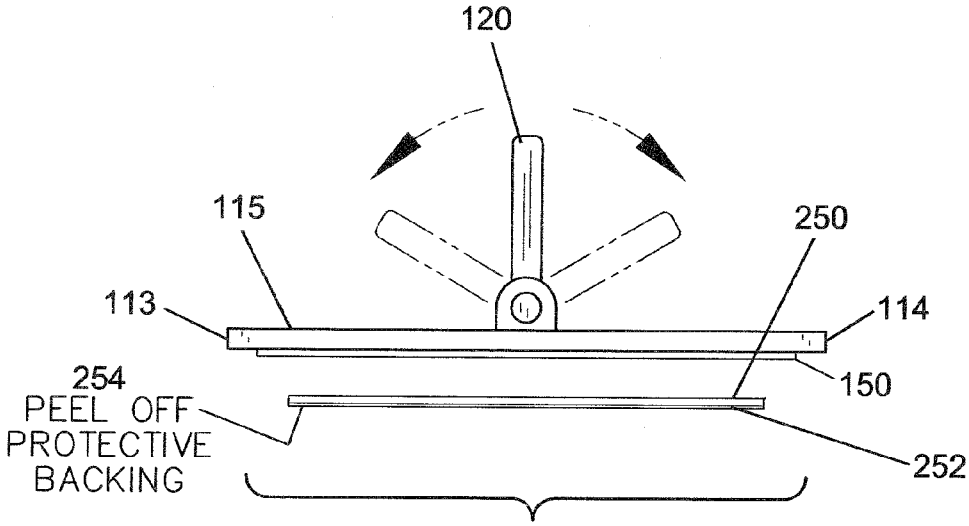
FIG. 3 is a side view of the system of FIG. 2.

A handle 120 is pivotally attached to the handle surface 115 of the panel 110. In some embodiments, the handle 120 can pivot in a first direction and a second direction (e.g., in the direction of the third end 113 and fourth end 114, respectively). In some embodiments, the handle 120 can pivot in a third direction and a fourth direction (e.g., in the direction of the first end 111 and the second end 112, respectively). The handle 120 may be constructed in a variety of shapes, styles, and configurations. For example, as shown in FIG. 2 and FIG. 3, the handle 120 may be a bar having two ends, each end being pivotally attached to the handle surface 115 of the panel 110 (e.g., the ends being pivotally attached at or near the first end 111 and the second end 112 of the panel 110 and the handle 120 pivoting in the first direction and the second direction).

Figure 4:
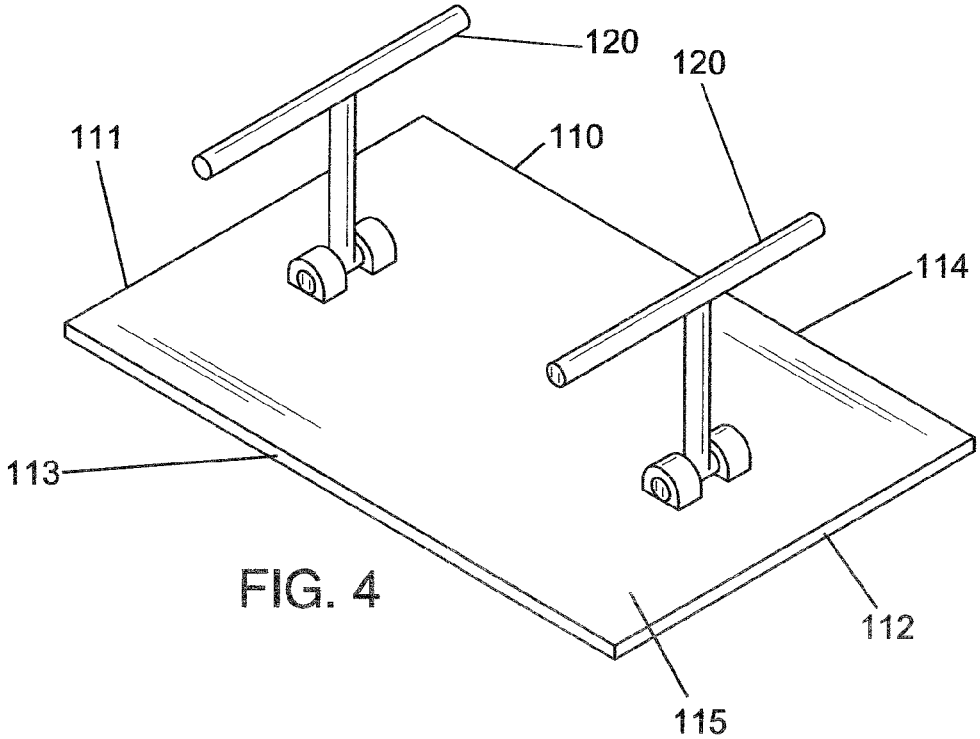
FIG. 4 is a perspective view of the system of an alternative embodiment of the present invention.
Figure 5:
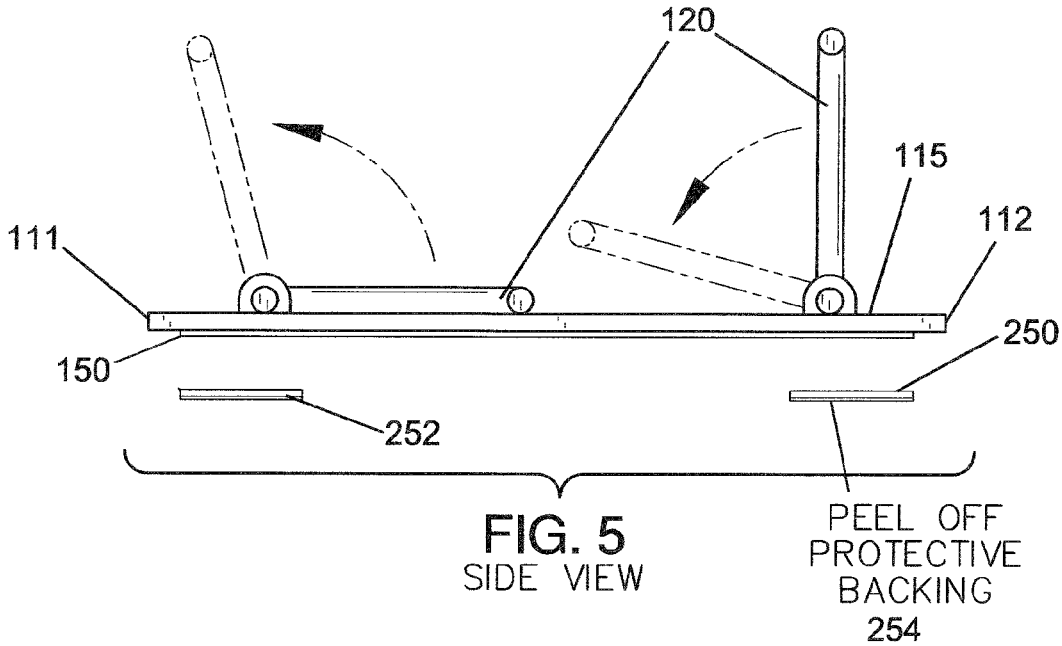
FIG. 5 is a side view of the system of FIG. 4.

As shown in FIG. 4 and FIG. 5, the handle 120 may be a T-bar or a pair of T-bars pivotally attached to the handle surface 115 of the panel 110 (the T-bars being attached at or near the first end 111 and/or the second end 112 of the panel 110 and the handle(s) 120 pivoting in the third direction and the fourth direction).

A first half attachment means 150 is disposed on the attachment surface 116 of the panel 110. The first half attachment means 150 is adapted to engage a second half attachment means 250 disposed on the electronic device (e.g., phone 101, tablet, etc.). In some embodiments, the first half attachment means 150 comprises a hook-and-loop fastener mechanism, a magnet mechanism, an adhesive mechanism, a latch mechanism, a clip mechanism, a snap mechanism, the like, or a combination thereof. As shown in FIG. 3, the system 100 may further comprise the second half attachment means 250 for attaching to the electronic device (e.g., phone 101, tablet, etc.). In some embodiments, the second half attachment means 250 comprises a device attachment component 252 (e.g., adhesive) for attaching the second half attachment means 250 to the electronic device (e.g., phone 101, tablet, etc.). In some embodiments, the device attachment component 252 is temporarily covered by a protective backing 254 so that the device attachment component 252 is not used until the user is ready to attach the second half attachment means 250 to the electronic device.

When not in use, the handle 120 can be pivoted to be flush against the panel 110.

As used herein, the term "about" refers to plus or minus 10% of the referenced number.

The disclosures of the following U.S. Patents are incorporated in their entirety by reference herein: U.S. Pat. No. 4,771,927; U.S. Design Pat. No. D363284; U.S. Pat. No. 5,537,472; U.S. Pat. No. 6,278,179; U.S. Pat. No. 7,542,565; U.S. Patent Application No. 2005/0277452; U.S. Patent Application No. 2005/0282598.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An electronic device holding system (100) for holding a smart phone, tablet, or electronic reader, said system (100) comprising:

(a) a panel having a first end (111), a second end (112) opposite the first end (111), a third end (113), a fourth end (114) opposite the third end (113), a handle surface (115), and an attachment surface (116);

(b) a handle (120) pivotally attached to the handle surface (115) of the panel (110), the handle (120) can pivot either in a first direction in the direction of the third end (113) of the panel (110) and a second direction in the direction of the fourth end (114) of the panel (110) or in a third direction in the direction of the first end (111) of the panel (110) and a fourth direction in the direction of the second end (112) of the panel (110); and (c) a first half attachment means (150) disposed on the attachment surface (116) of the panel (110) and a second half attachment means (250) for attaching to the smart phone (101), tablet, or electronic reader, the first half attachment means (150) is adapted to temporarily engage the second half attachment means (250);

wherein the handle (120) is a bar having two ends, each end being pivotally attached to the handle surface (115) of the panel (110) and the handle (120) pivoting in the first direction and the second direction.

2. An electronic device holding system (100) for holding a smart phone, tablet, or electronic reader, said system (100) comprising:

(a) a panel having a first end (111), a second end (112) opposite the first end (111), a third end (113), a fourth end (114) opposite the third end (113), a handle surface (115), and an attachment surface (116);

(b) a handle (120) pivotally attached to the handle surface (115) of the panel (110), the handle (120) can pivot either in a first direction in the direction of the third end (113) of the panel (110) and a second direction in the direction of the fourth end (114) of the panel (110) or in a third direction in the direction of the first end (111) of the panel (110) and a fourth direction in the direction of the second end (112) of the panel (110); and (c) a first half attachment means (150) disposed on the attachment surface (116) of the panel (110) and a second half attachment means (250) for attaching to the smart phone (101), tablet, or electronic reader, the first half attachment means (150) is adapted to temporarily engage the second half attachment means (250);

wherein the handle (120) is a pair of T-bar pivotally attached to the handle surface (115) of the panel (110) that can pivot in the third direction and the fourth direction.

* * * * *